United States Patent [19]

Baum

[11] 4,372,096

[45] Feb. 8, 1983

[54] DEVICE FOR VACUUM SEALING OF PRESERVING JARS

[76] Inventor: Günter Baum, Auhofstrasse 24, 8051 Zurich, Switzerland

[21] Appl. No.: 160,488

[22] Filed: Jun. 18, 1980

[30] Foreign Application Priority Data

Jun. 23, 1979 [CH] Switzerland ..... 5839/79

[51] Int. Cl.[3] ..... B65B 3/24; B67B 31/04

[52] U.S. Cl. ..... 53/88; 53/98; 53/103

[58] Field of Search ..... 53/88, 98, 103, 104, 53/105, 109; 99/472

[56] References Cited

U.S. PATENT DOCUMENTS

| | | | |
|---|---|---|---|
| 1,521,203 | 12/1924 | Roehrig | 53/98 X |
| 1,601,705 | 9/1926 | Staunton | 53/88 X |
| 2,135,059 | 11/1938 | Uren | 53/103 X |
| 2,155,397 | 4/1939 | Brandon | 53/103 X |
| 2,339,791 | 1/1944 | Mahlke | 53/88 |
| 2,406,771 | 9/1946 | Hughes | 53/88 |
| 2,436,849 | 3/1948 | Billetter | 53/88 X |
| 2,457,867 | 1/1949 | Chambers | 53/88 X |

*Primary Examiner*—Horace M. Culver
*Attorney, Agent, or Firm*—Cantor and Singer

[57] ABSTRACT

A device for sealing a preserving jaw by generation of a powerful vacuum in the head space of the jar. This is put into effect by a hood which is evacuated by means of an external vacuum pump, and is put over the jar's mouth loosely covered with a thin lid, the hood having an air tight seat on the jar. The lid is lifted by the vacuum inside of the hood and the air left within the jar is, consequently, evacuated. A special valve ensures that atmospheric air may not reenter the hood unless the lid had been pressed against the top edge of the jar's mouth, thus creating an air tight seat of both parts. The external overpressure keeps the jar tightly and durably sealed.

5 Claims, 5 Drawing Figures

Fig. 1
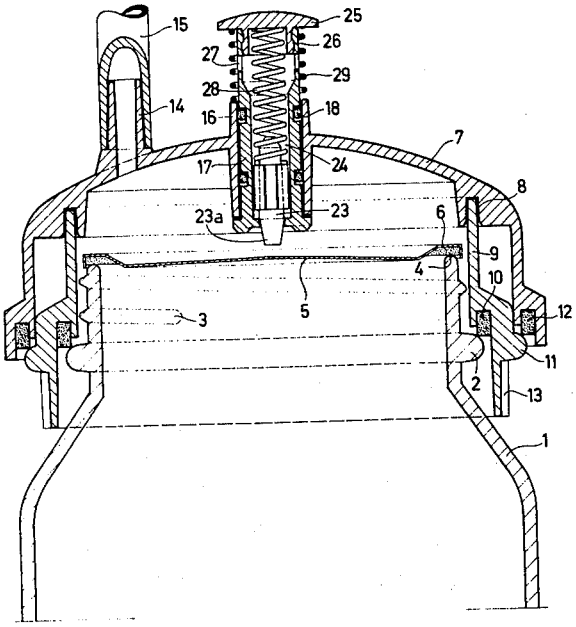
Fig. 3
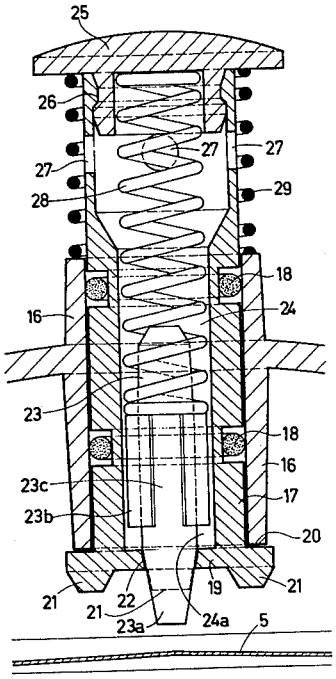
Fig. 2
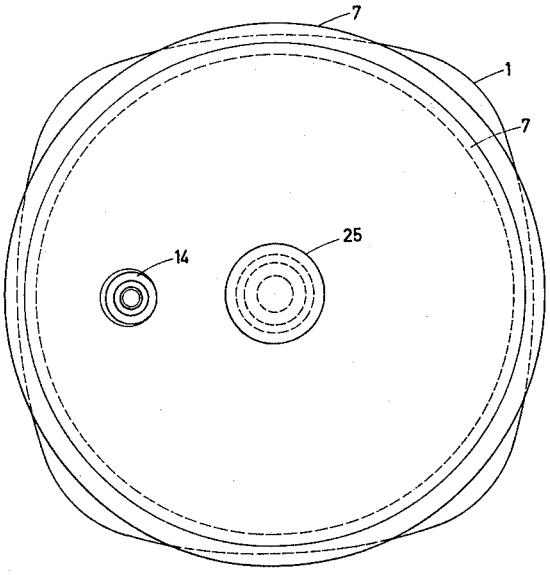
Fig. 4
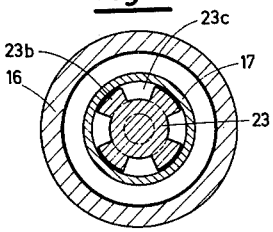
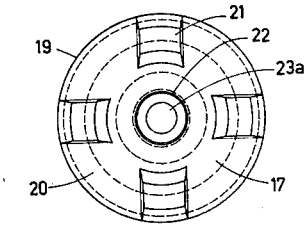
Fig. 5

DEVICE FOR VACUUM SEALING OF PRESERVING JARS

The present invention relates to a device for sealing by vacuum of preserving jars as used in the household, especially of such jars which are provided with thin, preferably metallic, lids the periphery of which on their inside is equipped with a resilient sealing compound, by which they rest on the top edge of the jar's mouth.

The jars of the mentioned kind proposed and used until now, generally are sealed in a way that a screw band or a second lid, both screwable on the mouth portion of the jar, is put over the mentioned thin lid in order to press the rim of the lid more or less powerfully against the top edge of the jar's mouth, according to the intensity of screwing. During subsequent cooking the air left within the jar expands from warming up and, in case that the intensity of screwing tolerates so, partially escapes, so that after cooling a partial vacuum is left within the jar, which is sufficient to allow tight sealing of the latter.

This procedure is unsatisfactory inasmuch as, by tightly screwing of the lids, the air warmed up within the jar can scarcely escape from there or, if the jar is cooked in a pressure cooker, the air cannot escape from the jar at all, because in this situation the pressure and the temperature inside and outside of the jar practically are equal.

In all events by temperature difference a sufficient vacuum can be created within the jar only if the initial air volume therein is a relatively large one. This is valid both in the event of cooking the jar and in case the separately bulk contents are hot filled into the cold jar.

Because of the mentioned imperfections the above method is insufficient.

The problem to be solved by the present invention is to seal jars of the described kind, especially of those which are filled with separately bulk cooked products, to seal the jars surely, independently from the initial volume of air, and without any heating procedure.

The invention solves the said problem as follows: A hood is put over the jar's mouth which is loosely covered with a thin lid. The hood is tightly supported by the jar. The interior of the hood is connected with a vacuum pump by means of a tube, thus creating a vacuum within the hood. Since the thin lid rests loosely on the mouth, the air within the jar escapes. A special valve manages that after evacuation, and in order to create an initial tightness between the lid and the edge of the mouth atmospheric air may enter the interior of the hood only after an adequate pressure had been performed onto the lid which initially had lain loosely on the top edge of the jar's mouth. The atmospheric pressure is set up very quickly again, inside of the hood, and creates a power which will press the lid against the top edge of the mouth, thus producing a durable and tight seal of the jar.

A preferred embodiment of the invention will now be described with reference to the accompanying drawing in which:

FIG. 1 is a cross section of the hood cut through a vertical plane of symmetry, FIG. 2 is a top plan view of the hood, FIG. 3 is the valve of FIG. 1, on a larger scale, FIG. 4 is a horizontal section through the valve of FIG. 3 on the level with the lower O-ring, and FIG. 5 is a bottom view of the valve.

In these figures, 1 indicates the preserving jar with the bead 2 and the thread 3 at the jar's neck. On the top edge 4 of the jar's mouth rests the thin, usually metallic, lid 5. On the side towards the jar the rim of the lid is coated with an easily deformable sealing compound 6. The hood 7 is designed clock-shaped preferably, for stability reasons.

Since the jars as available on the market have different sizes of mouths, it is desirable that the device can be adapted to these varieties. This can be realized best by application of adaptor rings. Such rings may be arranged inside or outside of the hood. In the present embodiment of the invention an inside arranged adaptor ring has been chosen, a solution that is preferable for several reasons: The volume of air that must be evacuated will be less that way, and the distance between bolt end 23*a* of the valve and lid 5 remains unchanged.

Inside of the hood 7 a circular groove 8 has been provided for fastening the adaptor ring 9. A tightening ring 10 made from resilient material is provided to ensure tight fitting on the bead 2 of the jar. The shape of the outside rim 11 of the adaptor ring 9 corresponds to the bead 2 of a jar whose size of mouth corresponds to the hood 7. Without the adaptor ring 9 the hood 7, by its tightening rings 12, would fit directly with the bead of a larger jar's mouth correspondingly. A knurl 13 is provided at the lower portion of the adaptor ring 9 in order to facilitate inserting and removing of the latter.

The tube 15 is fit onto the nozzle 14 making connection with the vacuum pump which has not been shown here, but could be, e.g., a water jet pump as described in my Swiss Patent Application No. 4903/76. Preferably the vacuum pump should be equipped with a check valve so that, in the event of putting the pump out of action, neither air nor operating water could stream back off the pump into the evacuated hood 7.

The special inlet valve for atmospheric air is positioned in the center of the hood 7. The external guide tube 16 of the valve is a portion of the hood itself. The hollow valve cylinder 17 slides within this guide tube 16. Two O-rings 18 ensure a tight fit between tube 16 and valve cylinder 17. The valve cylinder 17 is limited below by its bottom 19 forming a stop 20 which limits the upward travel. Small cams 21 projecting from the bottom 19 are provided in order to grant a free circulation of air when the valve bottom 19 contacts the lid 5. In the center of the bottom 19 a funnel-shaped bore 22 is provided which forms a tight seat for the tapered end 23*a* of the valve plug 23. Several grooves 23*c* parallel to the axis of the valve are provided on the guide cylinder 23*b* of the plug 23 so that a sufficient amount of air may pass by these grooves into the lower portion 24*a* of the hollow space 24 of the valve cylinder. At its upper end the hollow valve cylinder is closed with the valve head 25 by means of a snap connection 26. The atmospheric air enters the hollow valve cylinder by the inlet bores 27. The adequately prestressed spring 28 serves two functions: On one hand it grants a tight seat of the tapered end 23*a* of the valve plug 23 within the funnel-shaped bore 22 and on the other hand it enables the atmospheric air streaming by the bore 22 only when the end 23*a* of plug 23 is pressing with adequate power on the lid 5. The spring 29 is provided for keeping the whole valve in its initial position: this is necessary in order to enable a free lifting of the lid during evacuation. For the design of the spring 29 the following data must be taken into account: The weight of the movable portion of the valve, the friction of the O-rings 18, and the difference of pressure between the free atmosphere and the interior of the hood 7.

The device of the present invention operates as follows: After the hood 7 has been connected with the vacuum pump by means of the tube 15, it is put over the mouth of jar 1 which is loosely covered with the lid 5. An initial pressure on the hood creates a tight seat on the jar. The external aerostatic over-pressure created by the evacuation of the hood holds the latter tight against the jar, without any assistance from outside.

After the evacuation has been finished the vacuum pump, equipped with a check-valve, is put out of action, and the head 25 of the valve is depressed. The valve cylinder 17 then slides downwards and the end 23*a* of the valve plug presses onto the lid 5, so that the sealing compound 6 on its rim is pressed against the top edge 4 of the jar's mouth. Only after exceeding of the adequately designed prestressing of spring 28 the end portion 23*a* of the valve plug is pushed upwards into the bore 22, so that atmospheric air may stream through the bores 27, the grooves 23*c*, and finally through the free space of the bore 22 into the interior of the hood 7. There, by the entering air, the atmospheric pressure is set up most rapidly, keeping the jar 1 definitely sealed and releasing the hood which had been sucked against the jar before.

There is only little influence from the lid's weight on the difference of pressure between the interior of the hood on one hand and that of the jar on the other hand. At a pressure of 70 Torr inside of the hood, at a lid's weight of 6 grams, and at a 6 cm diameter of the jar's mouth that difference will be 0.156 Torr, i.e. about 0.22% which is practically negligable. At an atmospheric pressure of 730 Torr the resulting power pressing onto the lid would be about 25 kg which represents an absolutely sure seal of the jar.

What is claimed is:

1. A device for sealing preserving jars which are provided with a thin metallic essentially disc-like lid, the latter having on its rim a washer of an easily deformable material, the device comprising a hood which is put over the mouth of the jar loosely covered with said lid, and which hood fits tightly on the jar to form an enclosed chamber over said lid, means for connecting a vacuum source to said hood to create a vacuum in said chamber so that the air left within the jar escapes, and an externally manually operated valve means in said hood adapted to press said lid against said jar and then to let the atmospheric air stream into the chamber after evacuation of air has been finished, and only after the lid has been pressed with adequate power, tightly sealing against the top edge of the jar, said valve means being disposed at the center of said hood and comprising a guide tube extending through the hood and terminating in the neighborhood of the lid, a hollow valve cylinder which is closed at its top end slidingly disposed in said tube in sealing engagement and terminating at its lower end in a shoulder to engage the bottom of said tube and function as a stop to limit upward movement of said cylinder, said cylinder being normally biased in its uppermost position, a valve plug slidingly disposed in said cylinder and extending downwardly below said lower end, the outer wall of said plug being spaced from the inner wall of said cylinder to form a valve chamber, said plug being in sealing engagement with said lower end when the plug is in its lowermost position, and allowing communication between said enclosed chamber and said valve chamber when in a raised position, said plug being normally biased in its lowermost position, and inlet bores in said cylinder communicating said valve chamber with the atmosphere, whereby when external manual pressure is initially applied to said top end of said cylinder to provide a downward stroke thereto, first said downwardly extending plug contacts said lid to press the same against said jar, and when continued external manual pressure in an amount to overcome the biasing of said plug is applied to said top end of said cylinder, said stroke continues with concurrent relative movement between said cylinder and said plug thereby causing communication between said enclosed chamber and the atmosphere via said valve chamber and said inlet bores.

2. A device as claimed in claim 1, further comprising at least one adaptor ring for adapting the hood to the size of the mouth of the respective jar to be sealed.

3. A device as claimed in claim 2, wherein said adaptor ring fits over the mouth of the jar and said hood, in turn, fits over said adaptor ring.

4. A device as claimed in claim 1, wherein a tapered bore is provided through said lower end, said plug is tapered at its lower end to mate with said bore and is cylindrical at its upper end, having a plurality of longitudinal grooves in the cylindrical portion, said cylindrical portion having a greater diameter than said tapered portion, thereby forming a shoulder to limit downward movement of said plug.

5. A device as claimed in claim 1 or 4, wherein said cylinder has a plurality of depending feet on its lower end, said plug extending downwardly a greater distance than said feet.

* * * * *